US011160302B2

(12) United States Patent
Oda et al.

(10) Patent No.: US 11,160,302 B2
(45) Date of Patent: Nov. 2, 2021

(54) FLAVOR INHALER AND CUP

(71) Applicant: JAPAN TOBACCO INC., Tokyo (JP)

(72) Inventors: Takashi Oda, Tokyo (JP); Manabu Takeuchi, Tokyo (JP); Yasuhiro Shinozaki, Tokyo (JP); Takashi Hasegawa, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 491 days.

(21) Appl. No.: 15/351,073

(22) Filed: Nov. 14, 2016

(65) Prior Publication Data

US 2017/0055578 A1 Mar. 2, 2017

Related U.S. Application Data

(63) Continuation of application No. PCT/JP2015/063727, filed on May 13, 2015.

(30) Foreign Application Priority Data

May 15, 2014 (JP) ..... JP2014-101658

(51) Int. Cl.
*A24F 47/00* (2020.01)
*A24B 15/16* (2020.01)
(Continued)

(52) U.S. Cl.
CPC ..... *A24B 15/16* (2013.01); *A24B 15/165* (2013.01); *A24D 1/22* (2020.01); *A24F 42/10* (2020.01)

(58) Field of Classification Search
CPC ..... A24B 15/16; A24B 15/165; A24F 1/00; A24F 1/02; A24F 1/24; A24F 1/28;
(Continued)

(56) References Cited

U.S. PATENT DOCUMENTS 3,964,339 A * 6/1976 Antonio ..... B62K 21/26 74/551.9
4,219,032 A * 8/1980 Tabatznik ..... A24F 1/00 131/173
(Continued)

FOREIGN PATENT DOCUMENTS

EP 0342538 A2 11/1989
EP 0352109 A2 1/1990
(Continued)

OTHER PUBLICATIONS

International Search Report, issued in PCT/JP2015/063727, PCT/ISA/210, dated Jun. 30, 2015.
(Continued)

*Primary Examiner* — Eric Yaary
(74) *Attorney, Agent, or Firm* — Birch, Stewart, Kolasch & Birch, LLP

(57) ABSTRACT

A flavor inhaler (100) comprises a cup (50) having a cup shape. The cup is inserted into the holder (30) in a direction in which an opening of the cup is directed toward the ignition end side and a bottom plate (52) of the cup is arranged at the non-ignition end side. The cup has a claw portion (54) that protrudes into an inside of the cup from an inner wall surface of a side wall (51) of the cup. The claw portion has at least an engagement portion (54A) that engages an end surface of the combustion type heat source (70) in a non-ignition end side.

8 Claims, 3 Drawing Sheets

(51) Int. Cl.
*A24F 42/10* (2020.01)
*A24D 1/22* (2020.01)

(58) Field of Classification Search
CPC ..... A24F 1/32; A24F 25/00; A24F 2700/00; A24F 2700/04; A24F 2700/08; A24F 47/002; A24F 47/004; A24F 47/006; A24F 5/06; A24F 5/08; A24F 5/10; A24F 42/10; A24D 1/00; A24D 1/002; A24D 1/18; A24D 1/22; B25B 27/10; B25B 27/16
See application file for complete search history.

(56) References Cited

U.S. PATENT DOCUMENTS 4,585,014 A * 4/1986 Fry ..... A24F 13/16 131/175
4,713,020 A * 12/1987 Awano ..... H01R 4/50 439/267
4,756,318 A * 7/1988 Clearman ..... A24F 47/004 131/196
4,793,365 A 12/1988 Sensabaugh, Jr. et al.
4,966,171 A * 10/1990 Serrano ..... A24B 15/165 131/194
5,027,837 A * 7/1991 Clearman ..... A24F 47/004 131/194
5,105,831 A * 4/1992 Banerjee ..... A24F 47/004 131/194
5,345,951 A * 9/1994 Serrano ..... A24B 15/165 131/194
6,089,903 A * 7/2000 Stafford Gray ..... H01R 4/4818 439/439
2004/0226568 A1* 11/2004 Takeuchi ..... A24B 15/16 131/194
2010/0308481 A1* 12/2010 Oglesby ..... F23C 6/04 261/131
2013/0019888 A1 1/2013 Tsuruizumi et al.
2015/0374037 A1 12/2015 Akiyama et al.

FOREIGN PATENT DOCUMENTS

JP 53-38477 A 4/1978
JP 61-92558 A 5/1986
JP 5-103836 A 4/1993
WO WO 03/056949 A1 7/2003
WO WO 2011/118024 A1 9/2011
WO WO 2014/013054 A2 1/2014
WO WO 2014/136719 A1 9/2014

OTHER PUBLICATIONS

Written Opinion of the International Searching Authority, issued in PCT/JP2015/063727, PCT/ISA/237, dated Jun. 30, 2015.
Japanese Office Action for Japanese Application No. 2016-519283, dated Jul. 4, 2017, including an English translation.
Extended European Search Report for Application No. 15792132.1, dated Mar. 19, 2018.

* cited by examiner

FLAVOR INHALER AND CUP

TECHNICAL FIELD

The present invention relates to a flavor inhaler extending along a direction from an ignition end toward a non-ignition end, and a cup used for the flavor inhaler.

BACKGROUND ART

Conventionally, instead of cigarette, a flavor inhaler (smoking article) is proposed which allows for tasting flavor without burning a flavor source such as a tobacco. For example, there is known a flavor inhaler including: a combustion type heat source extending along a direction from an ignition end toward a non-ignition end (hereinafter, referred to as "longitudinal axis direction"); a flavor source configured by a tobacco material, etc.; and a holder configured to hold the combustion type heat source and the flavor source. There are various types of proposals for such a flavor inhaler.

For example, Patent Document 1 discloses a technology of holding the combustion type heat source and the flavor source by a container configured by a heat conductive member. The container has a cup shape having a bottom plate with a hole for introducing an aerosol generated from the flavor source to a non-ignition end side.

PRIOR ART DOCUMENT

Patent Document

Patent Document 1: U.S. Pat. No. 5,105,831

SUMMARY

A first feature is summarized as a flavor inhaler comprising: a tubular holder extending along a predetermined direction from an ignition end toward a non-ignition end; a combustion type heat source provided at the ignition end; a flavor source adjacent to the combustion type heat source at the non-ignition end side in the predetermined direction, the flavor source configured by a plurality of flavor pieces; and a cup configured to hold the combustion type heat source and to house the flavor source, the cup having a cup shape, wherein the cup is inserted into the holder in a direction in which an opening of the cup is directed toward the ignition end side and a bottom plate of the cup is arranged at the non-ignition end side, the cup has a claw portion that protrudes into an inside of the cup from an inner wall surface of a side wall of the cup, and the claw portion has at least an engagement portion that engages an end surface of the combustion type heat source in a non-ignition end side.

A second feature according to the first feature is summarized as that the claw portion has, in addition to the engagement portion, a holding portion configured to hold a side surface of the combustion type heat source, and the engagement portion is continued from the holding portion.

A third feature according to the second feature is summarized as that the holding portion has a tapered shape entering an inside of the cup from the ignition end side toward the non-ignition end side.

A fourth feature according to any one of the first feature to the third feature is summarized as that the cup has a flange that projects to an outside of the cup from an outer periphery of an opening of the cup.

A fifth feature according to any one of the first feature to the fourth feature is summarized as that an inner wall of the holder is provided with a heat conductive member that covers at least a part of a side surface of the cup and that extends to the non-ignition end side relative to the bottom plate of the cup.

A sixth feature according to any one of the first feature to the fifth feature is summarized as that the cup is integrally formed by a heat conductive member.

A seventh feature according to the sixth feature is summarized as that the heat conductive member is stainless steel.

An eighth feature according to any one of the first feature to the seventh feature is summarized as that a thickness of the cup is 0.1 mm or less.

A ninth feature according to any one of the first feature to the eighth feature is summarized as that the combustion type heat source has a through hole extending along the predetermined direction, an air hole is formed in the bottom plate of the cup, and the air hole is arranged at a position not overlapping with the through hole in a projection surface perpendicular to the predetermined direction.

A tenth feature is summarized as a cup configured to hold a combustion type heat source and to house a flavor source configured by a plurality of flavor pieces, the cup being applied to a flavor inhaler including the combustion type heat source and the flavor source, comprising: a body having a cup shape; and a claw portion that protrudes into an inside of the body from an inner wall surface of a side wall of the body, wherein the claw portion has at least an engagement portion configured to engage an end surface of the combustion type heat source at a non-ignition end side.

DESCRIPTION OF EMBODIMENTS

Figure 1:
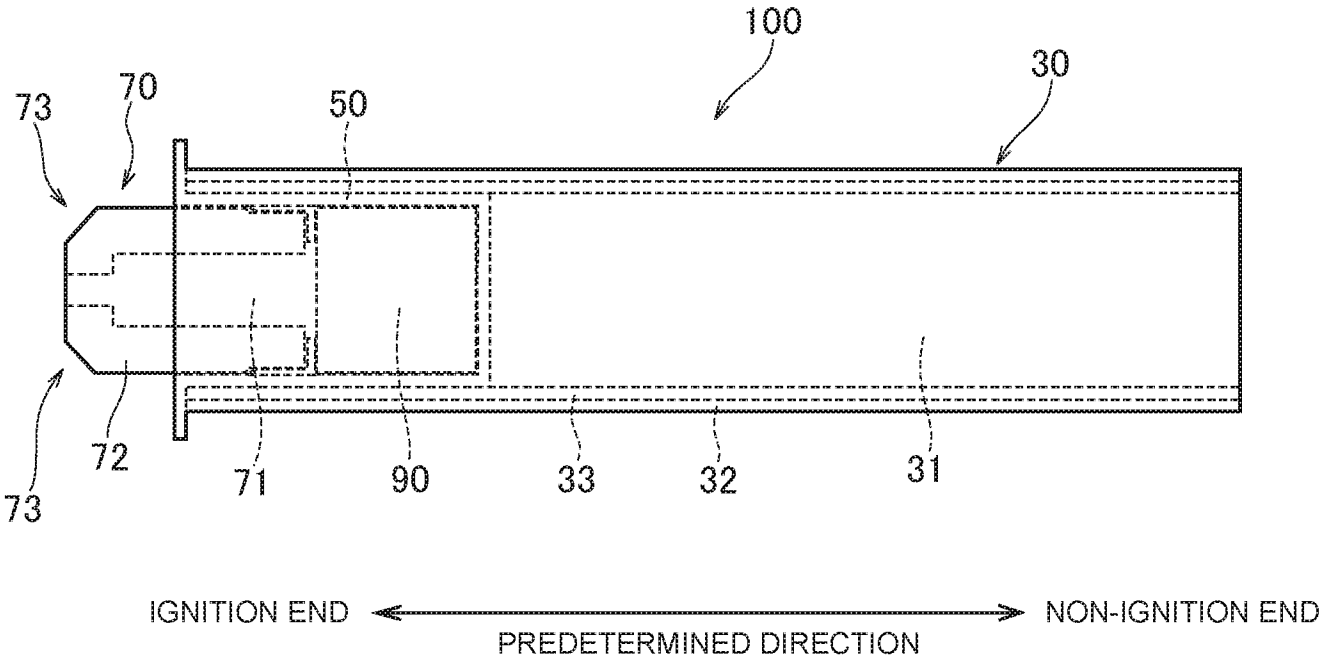
FIG. 1 is a diagram showing a flavor inhaler 100 according to a first embodiment.

Hereinafter, the embodiments of the present invention will be described with reference to the drawings. In the following drawings, identical or similar components are denoted by identical or similar reference numerals. However, it should be noted that the drawings are schematic, and the ratio and the like of each of the dimensions is different from the reality.

Therefore, specific dimensions should be determined with reference to the description below. It is needless to mention that different relationships and ratio of dimensions may be included in different drawings.

Overview of Embodiment

For the flavor inhaler mentioned in background art, a length (insertion length) of a combustion type heat source to be inserted into a container (hereinafter, cup) having heat conductivity as well as filling density of a flavor source and a length of a filled layer of the flavor source have significant influence on a flavor supplied to a user. In particular, the insertion length of the combustion type heat source as well as the filling density of the flavor source and the length of the filled layer of the flavor source have significant influence on conductive heat transfer behavior from the combustion type heat source to the flavor source via the cup. Further, the filling density of the flavor source and the length of the filled layer of the flavor source also have significant influence on air-flow resistance of the flavor inhaler (that is, ease of inhaling when the user performs inhalation) and an amount of flavor component generated from the flavor source. Therefore, it is important to appropriately control these parameters.

However, with the above-described container, it is difficult to appropriately control the insertion length of the combustion type heat source inserted into the container. Especially, when the flavor source is configured by a plurality of flavor pieces, the quantity (volume) of the flavor source is variable depending on the insertion length of the combustion type heat source, and thus, it is difficult to appropriately control the filling density of the flavor pieces configuring the flavor source and the length of the filled layer of the flavor pieces.

The flavor inhaler according to the embodiment includes a tubular holder extending along a predetermined direction from an ignition end toward a non-ignition end. The flavor inhaler includes: a combustion type heat source provided at the ignition end; a flavor source that is adjacent to the combustion type heat source at the non-ignition end side in the predetermined direction and that is configured by a plurality of flavor pieces; and a cup configured to hold the combustion type heat source and to house the flavor source, the cup having cup shape. The cup is inserted into the holder in a direction in which an opening of the cup is directed toward the ignition end side and a bottom plate of the cup is arranged at the non-ignition end side. The cup has a claw portion that protrudes into the inside of the cup from an inner wall surface of a side wall of the cup. The claw portion has at least an engagement portion that engages an end surface of the combustion type heat source at a non-ignition end side.

In the embodiment, the cup has a claw portion configured to have at least an engagement portion configured to engage an end surface of the combustion type heat source at the non-ignition end side. Therefore, it is possible to appropriately control the insertion length of the combustion type heat source, and it is possible to appropriately control the filling density and the length of the filled layer of flavor pieces configuring the flavor source. As a result, it is possible to stably supply flavor to a user.

First Embodiment (Flavor Inhaler)

Figure 2:
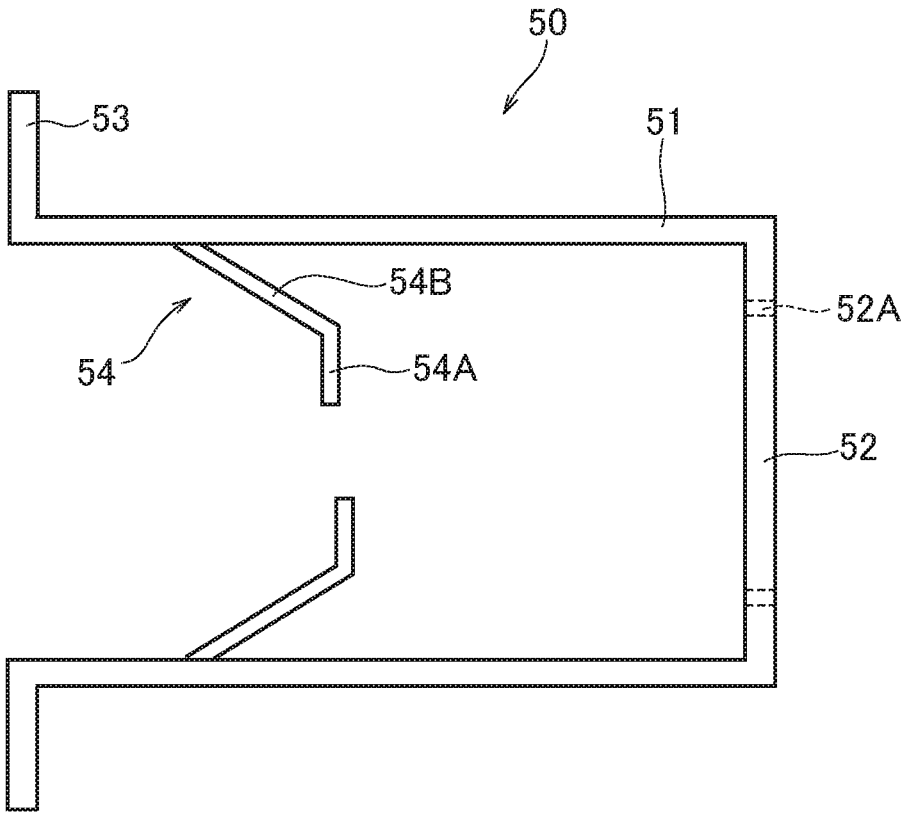
FIG. 2 is a diagram showing a cup 50 according to the first embodiment.

A flavor inhaler according to a first embodiment will be described, below. FIG. 1 is a diagram showing a flavor inhaler 100 according to the first embodiment. FIG. 2 is a diagram showing a cup 50 according to the first embodiment.

As shown in FIG. 1, the flavor inhaler 100 has a holder 30, a cup 50, a combustion type heat source 70, and a flavor source 90. In the first embodiment, it should be noted that the flavor inhaler 100 is a flavor inhaler without burning a flavor source.

The holder 30 has a tubular shape extending along a predetermined direction from an ignition end toward a non-ignition end. For example, the holder 30 has a cylindrical shape or a rectangular tubular shape. In particular, the holder 30 has a hollow 31, a body member 32, and a heat conductive member 33.

The hollow 31 extends in the predetermined direction. The body member 32 is, for example, a paper tube formed by bending a rectangular-shaped thick paper into a tubular shape after which the both edge portions of the thick paper are joined to each other. The heat conductive member 33 is arranged so as to cover at least a part of a side surface of the cup 50. Preferably, the heat conductive member 33 covers at least a part of the side surface of the cup 50 and extends to the non-ignition end side relative to the end surface (bottom plate 52 described later) at the non-ignition end side of the cup 50. That is, the heat conductive member 33 preferably covers at least a part of the side surface of the cup 50 and exposes to the hollow 31. The heat conductive member 33 is preferably formed of a metal material having an excellent heat conductivity, and is configured of aluminum, for example.

In the first embodiment, the holder 30 is formed by laminating the body member 32 and the heat conductive member 33. Specifically, the holder 30 includes: a thick paper that is the body member 32; aluminum that is the heat conductive member 33, and is configured by an aluminum-clad paper formed by bending the thick paper and the aluminum into a cylindrical shape. In other words, both of the body member 32 and the heat conductive member 33 have a tubular shape, and the heat conductive member 33 is provided over the entire inner wall of the body member 32. It is noted that the embodiment is not limited thereto, and the heat conductive member 33 only needs to cover at least a part of the side surface of the cup 50. That is, the heat conductive member 33 may not necessarily have a tubular shape.

The cup 50 has a side wall 51, a bottom plate 52, a flange 53 and a claw portion 54, as shown in FIG. 2. The cup 50 has a cup shape configured by the side wall 51 and the bottom plate 52. The cup 50 holds the combustion type heat source 70, and houses the flavor source 90. The cup 50 is inserted into the holder 30 in a direction in which an opening of the cup is directed toward the ignition end side and the bottom plate 52 of the cup 50 is arranged at the non-ignition end side.

The side wall 51 has a tubular shape and the bottom plate 52 covers one of a pair of openings configured by the side wall 51. An air hole 52A is formed in the bottom plate 52. For example, four air holes 52A are formed in the bottom plate 52. The size of the air holes 52A is preferably smaller than the size of the flavor pieces configuring the flavor source 90. In a projection surface perpendicular to the predetermined direction, the air holes 52A are preferably arranged at a position not overlapping with a longitudinal hollow 71 provided in the combustion type heat source 70 described later.

The flange 53 has a shape projecting from an outer periphery of an opening of the cup 50 to the outside of the cup 50. The flange 53 is engaged with an outer periphery of an opening of the holder 30 in a state where the cup 50 is inserted into the holder 30.

The claw portion 54 has a shape protruding from an inner wall surface of the side wall 51 of the cup 50 to the inside of the cup 50. The claw portion 54 has an engagement portion 54A and a holding portion 54B.

The engagement portion 54A engages the end surface of the combustion type heat source 70 at the non-ignition end side. The engagement portion 54A is a plate-shaped portion having an inclination approximately parallel to the bottom plate 52, and is continued from the holding portion 54B.

The holding portion 54B holds a side surface of the combustion type heat source 70. The holding portion 54B is provided to the inner wall surface of the side wall 51 of the cup 50. The holding portion 54B preferably has a tapered shape entering the inside of the cup 50 from the ignition end side toward the non-ignition end side.

The claw portion 54 is not particularly limited, but is preferably configured by a pair of claw portions facing to each other. An entire length of the holding portion has a tapered shape entering the inside of the cup from the ignition end side toward the non-ignition end side when the holding portion does not hold the combustion type heat source, as seen in FIG. 2. The holding portion holds the combustion type heat source by expanding the second end 54A of the holding portion toward the inner wall surface of the side wall of the cup 51 when the holding portion holds the combustion type heat source, as seen in FIG. 1. It is noted that, the embodiment is not limited thereto, and the claw portion 54 may be configured by three or more claw portions. In other words, the claw portion is configured by a plurality of claw portions arranged in a circumferential direction on the inner wall surface of the side wall of the cup, as depicted in FIG. 2. Alternatively, the claw portion 54 may continue over the entire circumference of the inner wall surface of the side wall 51 of the cup 50.

In the first embodiment, the cup 50 (that is, the side wall 51, the bottom plate 52, the flange 53 and the claw portion 54) is configured by a heat conductive member. Further, it is preferable that the cup 50 is integrally configured by the heat conductive member. For example, stainless steel is preferably used as the heat conductive member. For example, it is possible to use SUS430 as the stainless steel. In a case where the cup 50 is configured of stainless steel, the thickness of the side wall 51 of the cup 50 is preferably 0.1 mm or less.

Figure 3:
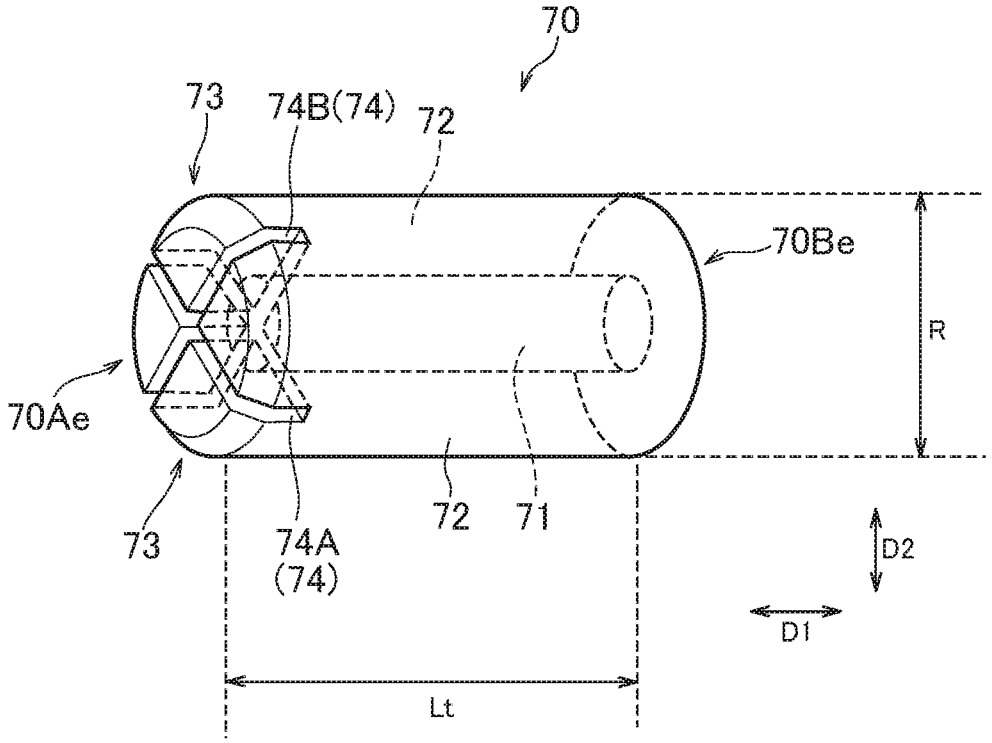
FIG. 3 is a diagram showing a combustion type heat source 70 according to the first embodiment.

The combustion type heat source 70 has a shape extending along a first direction D1 from an ignition end 70Ae toward a non-ignition end 70Be, as shown in FIG. 3. The combustion type heat source 70 has a longitudinal hollow 71, a side wall 72, a chamfered portion 73 and grooves 74 (groove 74A and groove 74B).

The longitudinal hollow 71 extends along the first direction D1 from the ignition end 70Ae toward the non-ignition end 70Be. The longitudinal hollow 71 is preferably provided at an approximately center of the combustion type heat source 70 in a perpendicular cross section perpendicular to the first direction D1. That is, the thickness of a wall body (side wall 72) configuring the longitudinal hollow 71 is preferably constant in the perpendicular cross section perpendicular to the first direction D1.

In the first embodiment, the number of longitudinal hollows 71 formed in the combustion type heat source 70 is preferably singular. The longitudinal hollow 71 has a first cross section area in the perpendicular cross section perpendicular to the first direction D1. The first cross section area of the longitudinal hollow 71 is 1.77 $mm^2$ or more.

In the first embodiment, the longitudinal hollow 71 is an example of a through hole extending along the predetermined direction. In the projection surface perpendicular to the predetermined direction, the air holes 52A provided to the bottom plate 52 of the cup 50 are preferably arranged at a position not overlapping with the longitudinal hollow 71.

The combustion type heat source 70 is configured by a flammable substance. For example, examples of the flammable substance include a mixture including a carbonaceous material, a nonflammable additive, a binder (organic binder or inorganic binder), and water. A material which is obtained by removing a volatile impurity through a heat treatment, etc., is preferably used as the carbonaceous material.

When the weight of the combustion type heat source 70 is 100 wt %, the combustion type heat source 70 preferably includes a carbonaceous material in a range of 30 wt % to 70 wt %, and more preferably includes a carbonaceous material in a range of 35 wt % to 45 wt %. In a case where the combustion type heat source 70 includes a carbonaceous material in the above-described preferable range, it is possible to achieve a more appropriate burning characteristic such as supply of a heat source, tightening of ashes, and the like.

For example, as the organic binder, it is possible to use a mixture including at least one of CMC-Na (carboxymethylcellulose sodium), CMC (carboxymethyl cellulose), alginate, EVA, PVA, PVAC, and saccharides.

For example, as the inorganic binder, it is possible to use a mineral-based binder such as purified bentonite or a silica-based binder such as colloidal silica, water glass, and calcium silicate.

For example, in view of a flavor, when the weight of the combustion type heat source 70 is 100 wt %, the binder preferably includes 1 wt % to 10 wt % of CMC-Na, and preferably includes 1 wt % to 8 wt % of CMC-Na.

As the nonflammable additive, it is possible to use, for example, a carbonate or an oxide including sodium, potassium, calcium, magnesium and silicon. When the weight of the combustion type heat source 70 is 100 wt %, the combustion type heat source 70 may include 40 wt % to 89 wt % of the nonflammable additive. Further, in a case where calcium carbonate is used as the nonflammable additive, the combustion type heat source 70 preferably includes 45 wt % to 60 wt % of the nonflammable additive.

In order to improve a burning characteristic, the side wall 72 may include 1 wt % or less of alkali metal salts such as sodium chloride and potassium chloride when the weight of the combustion type heat source 70 is 100 wt %.

The chamfered portion 73 is provided along an outer periphery of the ignition end 70Ae and has an inclination relative to the perpendicular cross section perpendicular to the first direction D1.

The grooves 74 are formed at the ignition end 70Ae and communicates to the longitudinal hollow 71. The grooves 74 are configured by the groove 74A and the groove 74B, and the groove 74A and the groove 74B cross each other and have a straight-line shape.

In the first embodiment, the size (Lt shown in FIG. 3) of the combustion type heat source 70 in the first direction D1 is preferably 5 mm or more and 30 mm or less, and more preferably 10 mm or more and 20 mm or less. Further, the size (R shown in FIG. 3) of the combustion type heat source 70 in a second direction D2 perpendicular to the first direction D1 is preferably 3 mm or more and 15 mm or less.

In the first embodiment, the length (protruding length) of exposure of the combustion type heat source 70 from the holder 30 is preferably 5 mm or more and 15 mm or less, and more preferably 5 mm or more and 10 mm or less. On the other hand, the insertion length of the combustion type heat source 70 into the holder 30 is preferably 2 mm or more and 10 mm or less, and more preferably 2 mm or more and 5 mm or less.

Here, in a case where the combustion type heat source 70 has a cylindrical shape, the size of the combustion type heat source 70 in the second direction D2 is an outer diameter of the combustion type heat source 70. In a case where the combustion type heat source 70 does not have a cylindrical shape, the size of the combustion type heat source 70 in the second direction D2 is a maximum value of the combustion type heat source 70 in the second direction D2.

The flavor source 90 is adjacent to the combustion type heat source 70 at the non-ignition end side in the predetermined direction. The flavor source 90 is configured by a plurality of flavor pieces. For example, it is possible to use a tobacco raw material as the flavor source 90. In such a case, the plurality of flavor pieces may be general shredded tobacco used in a cigarette (paper wrapped tobacco), or may be granular tobacco used in a snuff. Further, the flavor source 90 may include, in addition to a tobacco raw material, an aerosol source such as glycerin and propylene glycol, and may include a desired flavoring agent.

(Operation and effect)

In the first embodiment, the cup 50 includes the claw portion 54 having at least the engagement portion 54A that engages the end surface of the combustion type heat source 70 at the non-ignition end side. Therefore, it is possible to appropriately control the insertion length of the combustion type heat source 70, and it is possible to appropriately control the filling density of the flavor pieces configuring the flavor source 90 and the length of the filled layer of the flavor pieces. As a result, it is possible to stably supply flavor to a user.

In the first embodiment, the claw portion 54 has the holding portion 54B in addition to the engagement portion 54A. As a result, it is possible to control disengagement of the combustion type heat source 70. Further, the holding portion 54B has a tapered shape entering the inside of the cup 50 from the ignition end side toward the non-ignition end side. As a result, it is possible to control the disengagement of the combustion type heat source 70 even when there is a variation in an outer shape of the combustion type heat source 70.

In the first embodiment, the cup 50 has the flange 53 that projects to the outside of the cup 50 from the outer periphery of the opening of the cup 50. As a result, it is possible to constantly maintain the insertion length of the cup 50 relative to the holder 30 even when a mechanism configured to control the insertion length of the cup 50 relative to the holder 30 is not provided in the holder 30. Further, it is possible to constantly maintain the insertion length of the combustion type heat source 70 relative to the holder 30, and it is also possible to constantly maintain the length (protruding length) of exposure of the combustion type heat source 70 from the holder 30. The protruding length of the combustion type heat source 70 is constant, and thus, it is possible to secure a burning period during which a predetermined times of puffing is performed, and then it is possible to stabilize the burning characteristic of the combustion type heat source 70.

In the first embodiment, the cup 50 is integrally formed by a heat conductive member. As a result, the heat of the combustion type heat source 70 is conveyed to the flavor source 90 via the side wall 51 of the cup 50, and thus, it is possible to effectively heat the flavor source 90. Further, the cup 50 is integrally formed by stainless steel, and thus, it is possible to sufficiently maintain the strength of the cup 50 even when making the thickness of the side wall 51 of the cup 50 to be 0.1 mm or less. It is noted that when the thickness of the side wall 51 of the cup 50 is 0.1 mm or less, the heat of the combustion type heat source 70 is easily conveyed to the heat conductive member 33 via the side wall 51 of the cup 50. Further, the cup 50 is configured of stainless steel, and thus, it is possible to obtain corrosion resistance of the cup 50 against the combustion type heat source 70 including a carbonaceous material.

In the first embodiment, in the projection surface perpendicular to the predetermined direction, the air holes 52A formed in the bottom plate 52 of the cup 50 are arranged at a position not overlapping with the longitudinal hollow 71. As a result, the air inhaled from the longitudinal hollow 71 of the combustion type heat source 70 is diffused at the bottom plate 52 and a path through which the heat is conveyed from the combustion type heat source 70 is also diffused, and thus, it is possible to effectively heat the flavor source 90.

In the first embodiment, the heat conductive member 33 covers at least a part of the side surface of the cup 50 and extends to the non-ignition end side relative to the end surface (bottom plate 52 described later) at the non-ignition end side of the cup 50. As a result, the heat of the combustion type heat source 70 is conveyed to the heat conductive member 33 via the side wall 51 of the cup 50, and thus, an excessive supply of heat to the body member 32 of the holder 30 is prevented and the burning or thermal decomposition of the body member 32 is possibly prevented. Further, the combustion type heat source 70 is held by the cup 50 and the combustion type heat source 70 does not directly contact with the heat conductive member 33, and thus, it is possible to suitably use, as the heat conductive member 33, a member such as aluminum having excellent heat conductivity but having corrosiveness against a carbonaceous material.

Other Embodiments

The present invention is described through the above-described embodiments, but it should not be understood that this invention is limited by the statements and the drawings constituting a part of this disclosure. From this disclosure, various alternative embodiments, examples, and operational technologies will become apparent to those skilled in the art.

In the embodiment, a case is illustrated in which the claw portion 54 has the engagement portion 54A and the holding portion 54B. However, the embodiment is not limited thereto. For example, the claw portion 54 may not have the holding portion 54B and may be configured only by the engagement portion 54A.

In the embodiment, a case is illustrated in which the combustion type heat source 70 has a shape shown in FIG. 3. However, the embodiment is not limited thereto. The combustion type heat source 70 may have a shape that is disclosed in FIG. 9 and FIG. 10 of International Publication WO 2013/146951 A1. Specifically, the combustion type heat source 70 has an ignition end portion having the ignition end 70Ae and a body integrally formed with an ignition end portion and having the non-ignition end 70Be. The above-described longitudinal hollow 71 is formed in the body. The ignition end portion has a gap connected to the longitudinal hollow 71 in an extended direction of the longitudinal hollow 71. The gap is formed separately from the above-described groove 74A and groove 74B. The cross sectional size of the gap is similar to the cross sectional size of the longitudinal hollow 71.

In such a case, when the cross sections of the longitudinal hollow 71 and the gap are circular-shaped, the diameters φ of the longitudinal hollow 71 and the gap are, for example, 1.0 mm or more and 2.5 mm or less. The groove widths of the groove 74A and the groove 74B are smaller than the diameters φ of the longitudinal hollow 71 and the gap, and are, for example, 0.5 mm or more and 1.5 mm or less. The entire length (Lt shown in FIG. 3) of the combustion type heat source 70 in the predetermined direction is, for example, 10 mm or more and 20 mm or less. The length of the ignition end portion in the predetermined direction is, for example, 1 mm or more and 3 mm or less. In the predetermined direction, of the ignition end portion, the length of a region to which a chamfering process is performed is, for example, 0.5 mm. That is, in the predetermined direction, of the ignition end portion, the length of a region to which the chamfering process is not performed is, for example, 2.5 mm.

The entire content of Japanese Patent Application No. 2014-101658 (filed on May 15, 2014) is incorporated in the subject application by reference.

INDUSTRIAL APPLICABILITY

According to the embodiment, it is possible to provide a flavor inhaler and a cup that enable a stable supply of flavor to a user, by appropriately controlling the insertion length of a combustion type heat source as well as the filling density of flavor pieces configuring a flavor source and the length of a filled layer of the flavor pieces.

The invention claimed is:

1. A flavor inhaler comprising:

a tubular holder extending along a predetermined direction from an ignition end toward a non-ignition end;

a combustion type heat source provided at the ignition end;

a flavor source adjacent to the combustion type heat source at the non-ignition end side in the predetermined direction, the flavor source configured by a plurality of flavor pieces; and a cup configured to hold the combustion type heat source and to house the flavor source, the cup having a cup shape, wherein the cup is inserted into the holder in a direction in which an opening of the cup is directed toward the ignition end side and a bottom plate of the cup is arranged at the non-ignition end side, wherein the cup has a claw portion that protrudes into an inside of the cup from an inner wall surface of a side wall of the cup, and wherein the claw portion comprises:

an engagement portion that engages an end surface of the combustion type heat source in a non-ignition end side, a holding portion configured to hold a side surface of the combustion type heat source, wherein the engagement portion is continued from the holding portion, wherein a first end of the holding portion is integrated with the inner wall surface of the cup, wherein a second end of the holding portion is integrated with the engagement portion, and wherein an entire length of the holding portion has a tapered shape entering the inside of the cup from the ignition end side toward the non-ignition end side when the holding portion does not hold the combustion type heat source, wherein the holding portion is configured to hold the combustion type heat source by expanding the second end of the holding portion toward the inner wall surface of the side wall of the cup when the holding portion holds the combustion type heat source, and wherein the claw portion is configured by a plurality of claw portions arranged in a circumferential direction on the inner wall surface of the side wall of the cup.

2. The flavor inhaler according to claim 1, wherein the cup has a flange that projects to an outside of the cup from an outer periphery of an opening of the cup.

3. The flavor inhaler according to claim 1, wherein an inner wall of the holder is provided with a heat conductive member that covers at least a part of a side surface of the cup and that extends to the non-ignition end side relative to the bottom plate of the cup.

4. The flavor inhaler according to claim 1, wherein the cup is integrally formed by a heat conductive member.

5. The flavor inhaler according to claim 4, wherein the heat conductive member is stainless steel.

6. The flavor inhaler according to claim 4, wherein a thickness of the cup is 0.1 mm or less.

7. The flavor inhaler according to claim 1, wherein the combustion type heat source has a through hole extending along the predetermined direction, wherein an air hole is formed in the bottom plate of the cup, and wherein the air hole is arranged at a position not overlapping with the through hole in a projection surface perpendicular to the predetermined direction.

8. A cup configured to hold a combustion type heat source and to house a flavor source configured by a plurality of flavor pieces, the cup being applied to a flavor inhaler including the combustion type heat source and the flavor source, comprising:

a body having a cup shape; and a claw portion that protrudes into an inside of the body from an inner wall surface of a side wall of the body, wherein the claw portion comprises:

an engagement portion configured to engage an end surface of the combustion type heat source at a non-ignition end side, a holding portion configured to hold a side surface of the combustion type heat source, wherein the engagement portion is continued from the holding portion, wherein a first end of the holding portion is integrated with the inner wall surface of the cup, wherein a second end of the holding portion is integrated with the engagement portion, and wherein an entire length of the holding portion has a tapered shape entering an inside of the cup from the ignition end side toward the non-ignition end side when the holding portion does not hold the combustion type heat source, wherein the holding portion is configured to hold the combustion type heat source by expanding the second end of the holding portion toward the inner wall surface of the side wall of the cup when the holding portion holds the combustion type heat source, and wherein the claw portion is configured by a plurality of claw portions arranged in a circumferential direction on the inner wall surface of the side wall of the cup.

* * * * *